United States Patent [19]

Meise et al.

[11] 4,304,534

[45] Dec. 8, 1981

[54] PISTON CYLINDER FOR COMPRESSOR

[75] Inventors: Guenther Meise, Hanover; Herbert Unger, Springe, both of Fed. Rep. of Germany

[73] Assignee: WABCO Fahrzeugbremsen GmbH, Hanover, Fed. Rep. of Germany

[21] Appl. No.: 75,556

[22] Filed: Sep. 14, 1979

[30] Foreign Application Priority Data

Oct. 25, 1978 [DE] Fed. Rep. of Germany ..... 2846419

[51] Int. Cl.[3] ..... F04B 21/02; F04B 39/14

[52] U.S. Cl. ..... 417/569; 417/454; 137/454.4

[58] Field of Search ..... 417/559, 562–565; 137/454.4, 512

[56] References Cited

U.S. PATENT DOCUMENTS

| | | | |
|---|---|---|---|
| 1,708,158 | 4/1929 | Steadman | 137/512 |
| 1,996,762 | 4/1935 | Halleck | 417/564 |
| 2,000,735 | 5/1935 | Arnold | 137/454.4 |
| 2,019,747 | 11/1935 | Taylor | 137/454.4 |
| 2,213,257 | 9/1940 | Lamberton | 417/462 |
| 2,562,954 | 8/1951 | Schmidlin | 417/571 |
| 2,968,433 | 1/1961 | Ortega, Jr. | 137/454.4 |
| 2,984,408 | 5/1961 | Nicholas | 417/562 |

FOREIGN PATENT DOCUMENTS

| | | | |
|---|---|---|---|
| 2060663 | 3/1929 | Fed. Rep. of Germany | 417/565 |
| 1383097 | 11/1964 | France | 417/571 |

*Primary Examiner*—William L. Freeh
*Attorney, Agent, or Firm*—R. S. Visk

[57] ABSTRACT

A compressor cylinder head cast as a single piece casting to include a cylinder bore portion and a cylinder head. The cylinder head is cast with respective recesses for accommodating an intake valve and a discharge valve, such intake and discharge valves being identical in form and shape and, therefore, being interchangeable so that, during assembly of the cylinder head, no particular attention need be given to which valve is placed in which recess.

2 Claims, 3 Drawing Figures

PISTON CYLINDER FOR COMPRESSOR

BACKGROUND OF THE INVENTION

For purposes of assembly, the cylinder bore portion and cylinder head of a compressor cylinder normally comprises two parts. The lower portion of the cylinder head is designed as a valve plate for accommodating the intake and pressure discharge valves, with an intake valve spring disposed adjacent the lower side of the intake valve for biasing it toward a closed position. Since the valve plate also limits the compression space or chamber, the juncture between the head and bore portion must be hermetically sealed; this is only assured by extremely precise machining of the edges and by a seal. Compressors in which the valve plate comprises a separate component are also known.

The designs described above, therefore, comprise a large number of individual parts that are expensive to produce. It is conceivable that the number of necessary individual parts could be reduced by combining individual parts in one or a few castings.

However, it has been found that, when several individual parts are simply combined in a single casting, considerable problems are encountered in the mounting of the valve.

SUMMARY OF THE INVENTION

The object of the invention, therefore, is to provide a piston cylinder that can be produced largely as a single casting that provides simple means for assembly of the individual pieces.

Briefly, the present invention comprises a single die-cast design of the piston cylinder unit, and the design and arrangement of the valves it entails enables the valves to be assembled from one side of the unit and provides for the use of identical interchangeable intake and discharge valves, which results in lower costs, on the whole. The annular pressure space affords the possibility of a polydimensional arrangement of the pressure connection and of a large heat-transfer surface.

Due to a shortened intake path, the intake air is heated less and can be used for air and water cooling with less additional effort. Elimination of the cylinder head seal has the overall effect of optimum heat transfer between the cylinder bore portion and the cylinder head, which gives better theoretical air-conveying values for supply efficiency.

DESCRIPTION AND OPERATION

Figure 1:
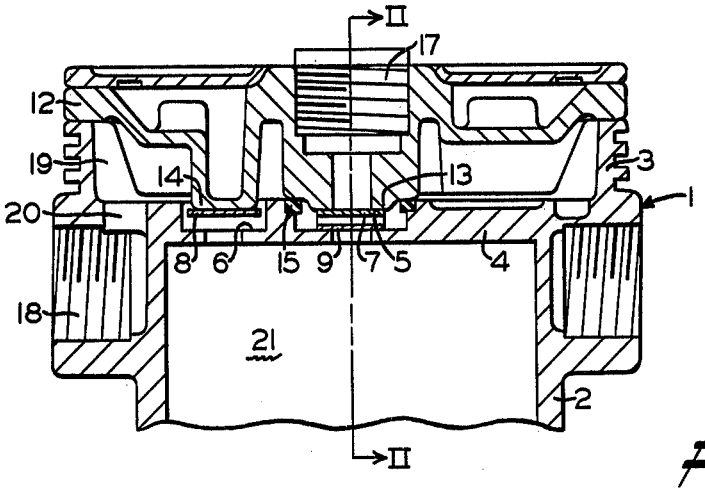
FIG. 1 is an elevational view, in section, of a single-piece compressor cylinder embodying the invention.
Figure 3:
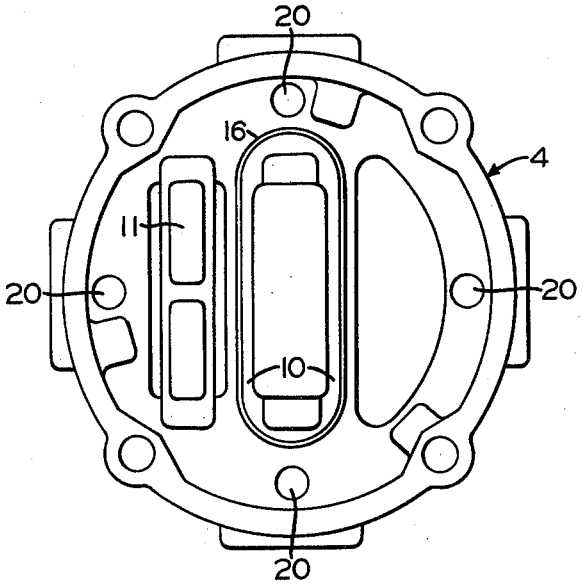
FIG. 3 is a horizontal view, in outline, of the cast valve plate.
Figure 2:
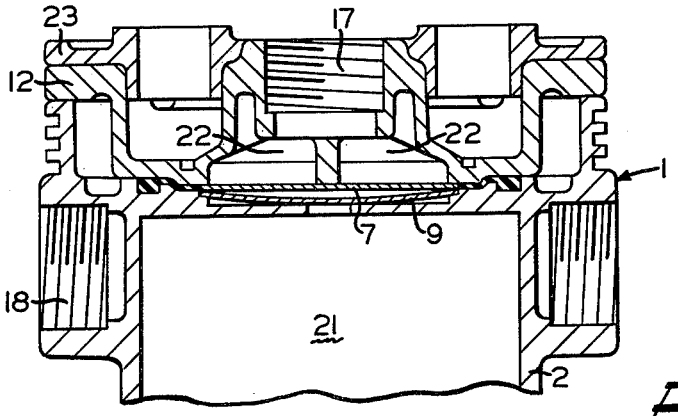
FIG. 2 is an elevational view, in section, taken along line II—II through the suction valve and looking in the direction of the arrows.

A piston cylinder 1, shown in FIGS. 1, 2 and 3, with a cylinder bore portion 2, a cylinder head 3 and a valve plate 4, comprises a single piece casting with an intake valve seat 5 and a discharge valve seat 6, both seats being cast in the valve plate 4 in the form of recesses. Respective intake and discharge valves are designed as simple, interchangeable and substantially rectangular plate type valves 7 and 8, which are disposed in the valve plate 4 on the intake valve seat 5 and the discharge valve seat 6, respectively. As shown in FIG. 3, a stroke-limiting plate type spring exerting a biasing force 9 in a direction opposite to intake air flow, is disposed in recess 5 and yieldable to limit the opening stroke of the intake valve 7. On the intake side, lateral slots 10 serve as intake channels, and a recess 11 serves as a discharge channel on the pressure side. The seal against atmosphere is provided by a cover 12, which is also produced by a casting process, the under side of said cover being designed such as to provide a seat 13 cooperating with intake valve 7, and a boss or stop member 14 for limiting the stroke of discharge valve 8, said valve 8 cooperating with seat 6. A spring (not shown), similar in form to spring 9, may be inserted in the recess with discharge valve 8, and serve to bias said discharge valve off valve seat 6, if desired. The intake side is sealed off from the discharge side of the cylinder by a sealing ring 15, whose seat 16 is also cast into the valve plate 4. An intake opening 17 cast in the cover 12 is provided for air intake, while a discharge opening 18 provides the connection for compressed air flowing past discharge valve 8, when unseated from valve seat 6, through an annular pressure space 19 surrounding the valve assemblies, and through channels 20 connected by means not shown to either a compressed air storage reservoir (not shown) or to consuming devices.

The external contours of cylinder 1 can be designed in such a way that the separation between the cylinder bore portion 2 and cylinder head 3 is not readily visible.

During a downward or intake stroke of the piston (not shown), a vacuum is formed in a cylinder compression chamber 21, so that the intake valve 7 is drawn away from its seat 13. Due to the bilateral seat 5 of valve 7, this unseating from the seat 13 consists of a flexure of the plate valve 7, the amount of such flexure or bending being determined by the spacing of seats 5, the thickness of valve plate 7, the degree of vacuum created, and the stroke limiting plate spring 9. Intake air is drawn into an internal intake channel 22 through intake opening 17, flows through slits 10 (see FIG. 3) and past open intake valve 7 into compression chamber 21. During this intake stroke, the closed discharge valve 6 seals off the compression chamber. When a predetermined degree of pressure is developed by the upward or compression stroke of the piston (not shown) in compression chamber 21, the intake valve 7 is pressed against seat 13 and seals said compression chamber from atmosphere. When the above-mentioned predetermined pressure is reached, discharge valve 8 lifts away or moves upwardly from its seat, and the opening stroke of 8 is limited by stop member 14; compressed air then flows into the annular pressure space 19 and from there to the consuming devices via pressure channels 20 and discharge opening 18.

The assembly jobs on the piston cylinder designed as a single casting consist of only two operations, namely inserting the rectangular lamellae 7, 8 in the recesses—no care need be taken to make sure they are not interchanged—and setting the cover 12 in place, which is provided with the suction valve seat 13, the stop member 14, the discharge valve 8, and the intake opening 17.

In addition, if a cover 23, provided with water connections is used, such water connections must also be made in the case of water-cooled compressors.

We claim:

1. A piston cylinder head for a compressor, said cylinder head comprising:

(a) a cylinder bore portion;

(b) a cylinder head;

(c) a valve-carrying plate, (d) said cylinder bore portion, said cylinder head, and said valve-carrying plate being cast as a single piece member with the valve-carrying plate fixed between the cylinder bore portion and the cylinder head, said valve-carrying plate having valve-accommodating recesses formed on opposite sides thereof;

(e) an intake valve operably disposed in the recess on one side of said plate;

(f) a discharge valve operably disposed in the recess on the opposite side of said plate;

(g) a cover member securable to said cylinder head for securing said intake valve and said discharge valve in assembled relation in the valve-carrying plate; and (h) a plate-type spring inserted in said recess on said one side with the intake valve for urging said intake valve toward a closed position and limiting the amount of the opening stroke thereat.

2. A piston cylinder head, as set forth in claim 1, wherein said intake valve and said discharge valve are identical in form and dimension and are, therefore, interchangeable.

* * * * *